United States Patent [19]

Stanwick

[11] 4,181,455

[45] Jan. 1, 1980

[54] APPARATUS FOR GENERATING ROTARY POWER IN A DEEP-SEA ENVIRONMENT

[76] Inventor: Tad Stanwick, 4715 Upton St., N.W., Washington, D.C. 20016

[21] Appl. No.: 910,567

[22] Filed: May 30, 1978

Related U.S. Application Data

[62] Division of Ser. No. 907,062, May 17, 1978.

[51] Int. Cl.[2] ..... E02D 13/00

[52] U.S. Cl. ..... 405/232; 405/224; 114/293

[58] Field of Search ..... 405/185, 181, 172, 223–228, 405/232, 242, 247, 248, 253, 259–261; 423/413; 60/398, 397, 411; 114/295, 337, 293, 338; 175/171; 173/DIG. 1

[56] References Cited

U.S. PATENT DOCUMENTS 3,872,672 3/1975 Rein ..... 60/649

*Primary Examiner*—Dennis L. Taylor

*Attorney, Agent, or Firm*—David H. Semmes

[57] ABSTRACT

Apparatus for generating rotary or turbine power within a deepsea environment, so as to drill a hole in the seabed and drop a mooring pile into the hole so drilled. Rotary turbine power is developed by admitting water through a submerged turbine and into an evacuated sphere. The turbine drives an auger which engages and drills a hole in the seabed. The apparatus includes a mooring pile support closure, adapted to drop a mooring pile into the hole which has been drilled in the seabed. An inorganic polymer may be supported within the evacuated sphere, so as to be reactant with admitted seawater for bleeding of pure water and hydrogen gas to a surface location.

8 Claims, 3 Drawing Figures

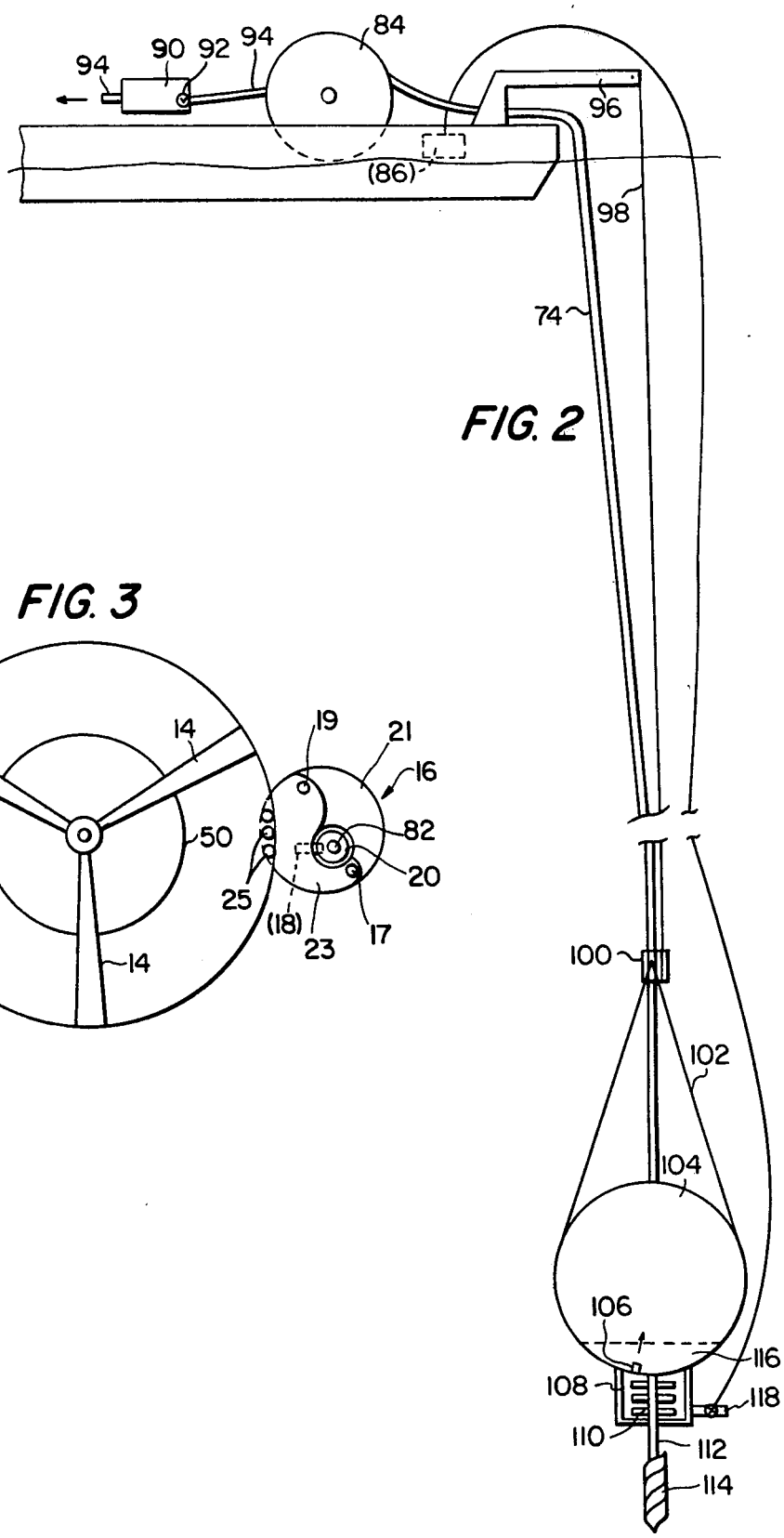
FIG. 2
FIG. 3
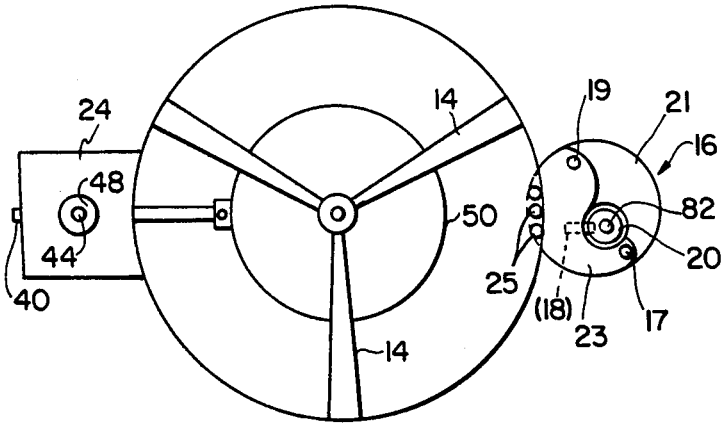

APPARATUS FOR GENERATING ROTARY POWER IN A DEEP-SEA ENVIRONMENT

CROSS-REFERENCES TO RELATED APPLICATIONS

An improvement upon applicant's Method and Apparatus for Anchor Embedment, U.S. Pat. No. 3,118,417. This application is a division of applicant's Method of Generating Rotary Power in a Deepsea Environment Ser. No. 907,062, filed May 17, 1978.

BACKGROUND OF THE INVENTION

1. Field of the Invention

Generating rotary power in the deepsea environment, for example 1,000 fathoms or greater, particularly developing torque or rotary power by means of admitting ambient seawater through a rotary turbine and into an evacuated sphere, while bleeding the water to a surface location. An auger attachable to the turbine shaft may drill a hole in the seabed and the entire apparatus may be laterally rotated so as to drop a mooring pile into the hole. The invention, of course, may be practical at lesser ocean depths.

2. Description of the Prior Art

Submitted under the provisions of 37 C.F.R. 1.97.

SUMMARY OF THE INVENTION

According to the present invention rotary power is developed underwater by supporting a rotatable turbine and an evacuated sphere in communicant relationship, submerging the turbine and evacuated sphere to a working depth and admitting water through the turbine and into the sphere, so as to drive the turbine. An auger may be affixed to the turbine shaft such that rotation of the turbine rotates the auger, as in drilling the seabed. The capacity of the evacuated sphere for admission of ambient seawater may be enhanced by supporting an inorganic polymer within the sphere for reaction with admitted seawater. The reaction develops pure seawater and atomic hydrogen, which may be bled off simultaneously to a surface vessel or location. The hydrogen gas may be used for powering a surface vessel or equipment. A suggested device may include a rotatable frame such that one or more mooring piles may be carried with the turbine and sphere to the working location adjacent the seabed, then dropped into the holes which have been drilled.

BRIEF DESCRIPTION OF THE DRAWINGS

FIG. 2 is a schematic view of a modification of the proposed apparatus consisting solely of an underwater turbine with an auger attached to its sphere. The turbine housing is communicant with an evacuated sphere, which includes a bleed off line extending to a surface vessel.

FIG. 3 is a top plan of the apparatus, illustrated in FIG. 1.

DESCRIPTION OF THE PREFERRED EMBODIMENTS

Figure 1:
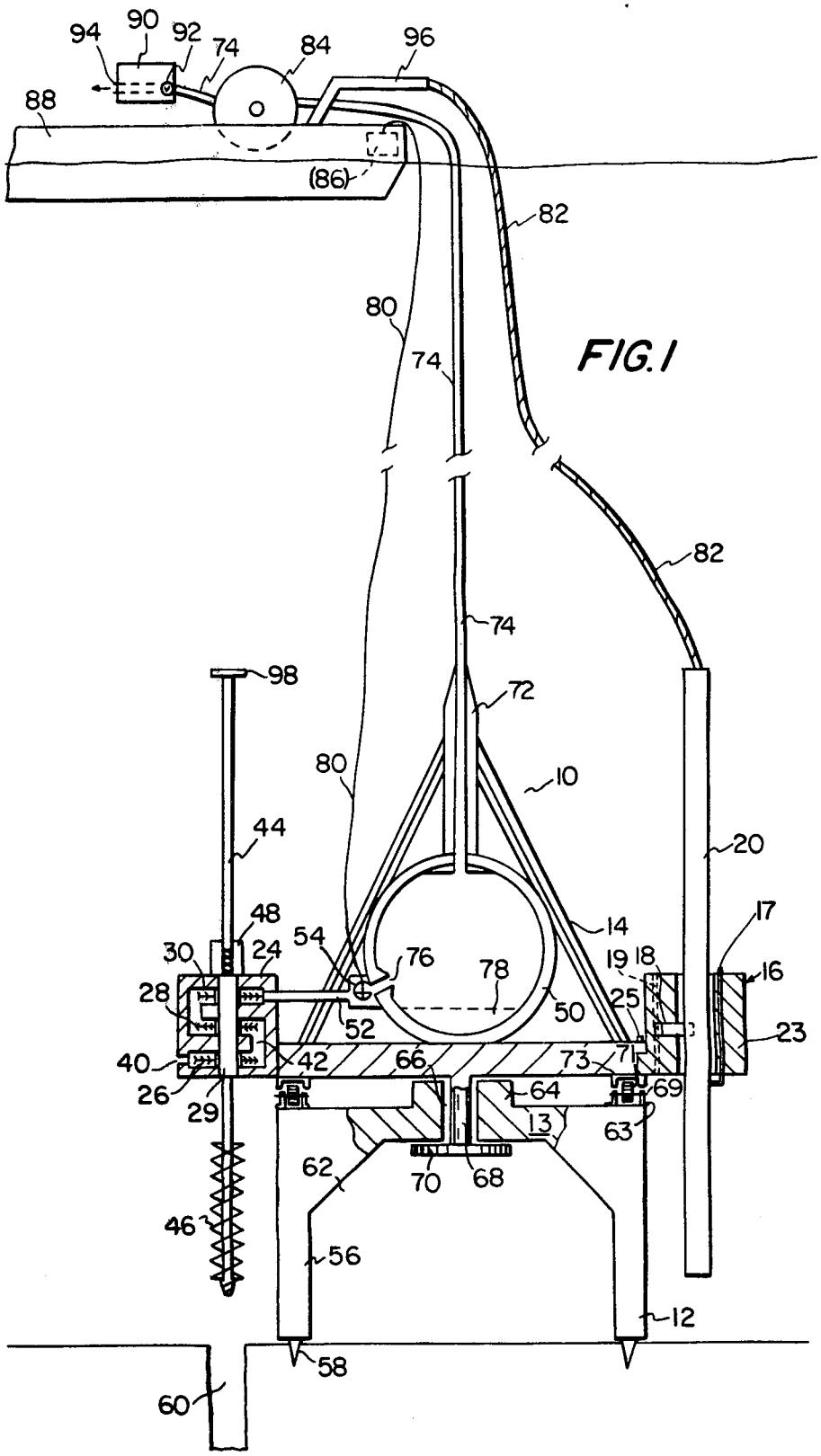
FIG. 1 is a fragmentary schematic view of an apparatus lowered from a surface vessel to the seabed for drilling of a mooring pile hole by means of the auger attached to the turbine shaft. Upon completion of drilling the upper frame is rotated and a vertically disposed mooring pile may be dropped into the hole so drilled.

In FIGS. 1 and 2 there is illustrated a suggested apparatus for developing rotary or turbine power underwater, while supporting, then dropping a vertically disposed pile into the hole drilled by the rotary power. The device, generally designated as 10, includes a base 12 having a horizontal platform 13 supported upon vertical legs 56 and flanges or support studs 62. Each leg may have a downwardly extending spike 58 or the like for engagement in the seabed. Base 13 may have an annular central bearing point 64, defining a vertical aperture 66 for engagement with the top frame 14. Shaft 68 may be secured to bearing point 64 and the base 13 by means of horizontal flange 70. A pile positioner and release mechanism 16 may be supported at the periphery of frame 14 and includes a horizontally extensible pin 18 or the like, so as to releasably secure a mooring pile 20 within the mechanism. Manifestly, any number of such mechanisms 16 may be positioned at the periphery of frame 14.

Turbine housing 24 may be diametrically positioned on frame 14, so as to support in conduit 42 a plurality of turbine blades mounted upon vertical shaft 29. An auger 44 having bit 46 and flanged top 98, may be positioned co-axially upon turbine shaft 29 so as to be driven thereby. Also, a directional switching unit 48 may be provided such that admission of ambient seawater through entry 40 and through conduit 42 may rotate the turbine. A limit switch may be mounted atop turbine housing 24, so as to be activated by flanged top 98. Upon actuation of the limit switch, continued rotation of the turbine blades will be upon cross or reverse threads in shaft 29, so as to reverse rotated shaft 29 for upward movement out of seabed hole 60. An evacuated sphere 50 may be supported centrally of frame 14 and include a conduit 52 communicant with turbine conduit 42. A control or inlet valve 54 may be actuated by means of electrical connection 80 or the like extending to a surface vessel control or switching station 86.

As will be apparent, admission of ambient seawater through inlet 40, conduits 42 and 52 and into evacuated sphere 50 causes rotation of turbine blades 28 and shaft 29 for drilling actuation of bit 46. Shaft 44 may be threaded, such that rotation may lower the bit 46 for drilling of core hole 60 within the seabed.

An inorganic polymer 78 of the type described in U.S. Pat. No. 4,029,747 may be supported within evacuated sphere 20 for reaction with admitted seawater. As a result, the admitted seawater is purified, such that pure water and hydrogen may be bled from the sphere through flexible conduit 74 supported within guide 72 and extending to a surface vessel 88.

Flexible conduit 74 may be similar to that used for underwater telephone cables with core removed so as to define a reduced diameter axial conduit reinforced against ambient pressure by the exterior sheathing. Conduit 74 may extend through hose reel 84 and into surface priming pump 90, utilizing control valve 92 for discharge of water through outlet 94. Manifestly, the hydrogen gas bubbles, released with water globules into conduit 74, serves as a propellant for the water. Also, this gas may be recovered at the surface location for use in powering surface equipment.

In FIG. 2 there is illustrated a modified apparatus consisting of evacuated sphere 104 communicant with the surface via pipeline 74, as in FIG. 1. A cable 98 may extend from boom 96 to swivel 100 which carries harness 102 for support of evacuated sphere 104. A turbine housing 108 may be attached beneath the sphere for housing turbine 110 upon shaft 112, so as to drive bit or auger 114. As will be apparent, admission of ambient seawater through inlet 118 and housing 108 and into evacuated sphere 104 via inlet 106 will drive the turbine. The apparatus after drilling of a hole in the ocean bottom may be removed for dropping of a mooring pile and grouting into place.

Manifestly, various types of apparatus may be provided for supporting the turbine and evacuated sphere elements. For example, a plurality of pile positioner and release mechanisms may be positioned about the periphery of frame 14 and rotated into place as auger 46 drills each hole. Thus, for example a ring of mooring piles might be positioned in place or the mooring piles may be dropped in longitudinal alignment, if the apparatus is moved appropriately across the seabed. As will be apparent the ocean depths will provide extraordinary opportunities for generating power according to the present method. The pile may be rubber-covered, so as to provide flexibility, and may include pivoted flukes, so as to prevent withdrawal after setting in the seabed core hole.

I claim:

1. Apparatus for generating rotary power in a deep-sea environment comprising:

A. A base engageable with the seabed;

B. A rotatable frame mounted upon said base and defining at its periphery a turbine housing and a pile support closure;

C. A rotary turbine mounted upon a vertical shaft in said turbine housing and having an inlet in communication with ambient underwater and an outlet;

D. An evacuated sphere supported upon said frame, including a conduit extending between said turbine housing outlet and said evacuated sphere, so as to admit water from said turbine into said sphere;

E. An auger mounted upon said rotary turbine vertical shaft, such that rotation of said turbine rotates said drill; and F. A flexible bleedoff conduit extending from said evacuated sphere to a surface location.

2. In an apparatus for generating rotary power underwater the combination of claim 1, in further combination with an inorganic polymer supported in said evacuated sphere, so as to be reactant with admitted water, while developing a gas as a propellant for said water in said bleed off conduit.

3. Apparatus for generating rotary power in a deep-sea environment comprising:

A. A base engageable with the seabed;

B. A rotatable frame mounted upon said base and defining at its periphery a turbine housing and a pile support closure;

C. A rotary turbine having a directional switching unit and being mounted upon a vertical shaft in said turbine housing and having an inlet in communication with ambient underwater and an outlet.

D. An evacuated sphere supported upon said frame, including:

(i) a conduit extending between said turbine housing outlet and said evacuated sphere, so as to admit water from said turbine into said sphere;

(ii) a control valve mounted in said conduit so as to regulate admitting of water into said sphere and thus rotation of said turbine, and (iii) as inorganic polymer as a reactant with admitted water;

E. An auger mounted upon said rotary turbine vertical shaft, such that rotation of said turbine rotates said drill in either direction, accordingly as said directional switching unit is activated.

F. A flexible bleedoff conduit extending from said evacuated sphere to a surface location; and G. A mooring pile releasably supported in said pile support closure.

4. Apparatus for generating rotary power underwater as in claim 3, said pile being supported in a vertical attitude and including a mooring cable extending towards the surface.

5. Apparatus for generating rotary power underwater as in claim 4, said mooring cable being buoyantly supported.

6. Apparatus for generating rotary power underwater as in claim 4, said pile support closure including a retention and release mechanism engagable with said pile, so as to retain said pile above the ocean bed prior to release and dropping into a hole drilled by said auger.

7. Apparatus for generating rotary power underwater as in claim 6, said base including at its periphery a plurality of rollers mounted upon horizontal axes and said frame including at its bottom a circular track complementally engageable with said rollers.

8. Apparatus for generating rotary power underwater as in claim 7, said frame being rotatable upon a vertical axis, so as to release sequentially said mooring pile into a hole drilled by said auger.

* * * * *